US007748436B1

(12) United States Patent
Anderson et al.

(10) Patent No.: US 7,748,436 B1
(45) Date of Patent: Jul. 6, 2010

(54) EVAPORATOR FOR CAPILLARY LOOP

(75) Inventors: William G. Anderson, Boundbrook, NJ (US); David Sarraf, Elizabethtown, PA (US); Peter M. Dussinger, Lititz, PA (US); John R. Hartenstine, Mountville, PA (US)

(73) Assignee: Advanced Cooling Technologies, Inc, Lancaster, PA (US)

( * ) Notice: Subject to any disclaimer, the term of this patent is extended or adjusted under 35 U.S.C. 154(b) by 803 days.

(21) Appl. No.: 11/416,731

(22) Filed: May 3, 2006

(51) Int. Cl.
*F28D 15/00* (2006.01)
*H05K 7/20* (2006.01)

(52) U.S. Cl. ..... 165/104.26; 165/104.21

(58) Field of Classification Search ..... 165/104.26, 165/104.21, 104.33; 361/700; 257/715; 174/15.2
See application file for complete search history.

(56) References Cited

U.S. PATENT DOCUMENTS 4,467,861 A * 8/1984 Kiseev et al. ..... 165/104.22
4,883,116 A * 11/1989 Seidenberg et al. .... 165/104.26
6,058,711 A 5/2000 Maciaszek et al.
6,227,288 B1 5/2001 Gluck et al.
6,330,907 B1 * 12/2001 Ogushi et al. ..... 165/104.26
6,381,135 B1 4/2002 Prasher et al.
6,533,029 B1 * 3/2003 Phillips ..... 165/104.26
6,926,072 B2 8/2005 Wert
2003/0010477 A1 * 1/2003 Khrustalev et al. ..... 165/104.33
2003/0159808 A1 * 8/2003 Hoang ..... 165/104.26
2003/0178184 A1 * 9/2003 Kroliczek et al. ..... 165/104.26
2005/0092469 A1 * 5/2005 Huang ..... 165/126

FOREIGN PATENT DOCUMENTS

JP 2005233480 A * 9/2005

* cited by examiner

*Primary Examiner*—Tho V Duong
(74) *Attorney, Agent, or Firm*—Martin Fruitman

(57) ABSTRACT

The apparatus is a capillary loop evaporator in which the vapor space is the internal volume of a cup shaped evaporator wick with sidewalls in full contact with the outer casing of the evaporator. Liquid is furnished to the wick through thicker wick wall sections, slabs protruding from the liquid-vapor barrier wick, eccentric wick cross sections, or tunnel arteries. The tunnel arteries can also be formed within heat flow reducing ridges protruding into the vapor space. The tunnel arteries can be fed liquid by bayonet tubes or cable arteries, and can be isolated from the heat source with regions of finer wick to impede vapor flow into the liquid. Tunnel arteries also enable separation of the evaporator and the reservoir for thermal isolation and structural flexibility. A wick within the reservoir aids collection of liquid in low gravity applications.

13 Claims, 9 Drawing Sheets

EVAPORATOR FOR CAPILLARY LOOP

BACKGROUND OF THE INVENTION

This invention deals generally with heat transfer and more particularly with a capillary loop evaporator that has full thermal contact of the wick with the heat input surface.

A capillary loop and a loop heat pipe are devices for transferring heat by the use of evaporation at the source of heat and condensation at the cooling location, and they eliminate some of the limitations of a simple heat pipe by separating the vapor and liquid movement into different conduits. Thus, liquid fed to an evaporator is evaporated and moves through a vapor transport line to the condenser, and condensate moves from the condenser to the evaporator through a liquid transport line. Typically, a liquid reservoir is constructed in close vicinity to the evaporator and a barrier wick separates the liquid in the reservoir from the vapor in the evaporator while moving liquid into the evaporator wick by capillary action.

Prior art capillary loop and loop heat pipe evaporators typically have vapor channels at the contact boundary between the evaporator wick and the heat input surface, which is the wall of the evaporator enclosure. The vapor channels are formed as grooves in the wick or the evaporator enclosure inner wall at the boundary, and the lands between the grooves are the only direct thermal path from the heat input surface to the liquid within the wick. From the wick the liquid is evaporated and fed into the vapor channels. The vapor channels then open into a vapor space that is available to the vapor transport line. Some such devices, such as that disclosed in U.S. Pat. No. 6,058,711 to Maciaszek et al, even have the vapor generating wick completely surrounded by the thermally insulating vapor space.

Basic limitations of the typical capillary loop evaporator are the limited direct contact between the wick and the heated surface, and the tendency of the vapor generated at the heat transfer surface to interfere with heat transfer into and through the wick. Another disadvantage of the conventional loop heat pipe evaporator is its proximity and thermal transfer to the reservoir. This phenomenon is referred to as parasitic heat loss or heat leakage, and it causes some heat to be transferred from the evaporator to the reservoir by means of heat conduction across the wick and two phase heat transfer in the central volume which the wick surrounds. Such heat is therefore not moved to the condenser for disposal. Still other problems arise in the difficulty of manufacturing capillary loop and loop heat pipe evaporators since they usually require cylindrical wicks with longitudinal grooves on the outer surface.

It would be very beneficial to have available a capillary loop evaporator that has improved heat transfer from the heat source to the evaporator wick, reduced parasitic heat leakage to the reservoir, and reduced manufacturing complexity.

SUMMARY OF THE INVENTION

The present invention is a capillary loop evaporator wick that has full contact at its outer boundary with the walls of the heated enclosure within which it is installed. In its simplest form the evaporator has a cup with sidewalls of wick material installed tightly against the inside walls of an enclosure of heat conductive material, and in most embodiments the cup has an integral end wall at one end extending across the entire enclosure and resembling a cup bottom. The end wall acts as a barrier between the vapor space in the center of the cup and the liquid reservoir on the other side of the end wall of the cup, and the barrier can be made of impervious material or porous capillary material.

The capillary pumping action of the barrier of wick material and the wick sidewalls of the cup deliver the liquid all along the boundary of the wick and the heated enclosure wall at which location it is vaporized. After the vapor is formed it moves across the wick sidewalls into the vapor space without significant interference from other vapor, and is replaced by other liquid within the wick. The open end of the wick cup is located near an end cap of the enclosure to which is attached the vapor line connecting the evaporator to the condenser.

Several structural variations can be added to enhance the performance of the simple cup of wick material. One such modification is selection of the sidewall wick thickness and pore size to accommodate different liquids within the capillary loop and different heat loads.

Another structure that can be used advantageously when the heat input is located in a specific area of the enclosure is wick sidewalls of varying thickness. In such a structure the sidewall adjacent to the heated area of the enclosure is formed with a thinner cross section to more easily permit the vapor to escape from the wick and thus maintain a lower evaporative temperature drop. Thicker sidewall sections are used adjacent to the enclosure wall where heat is not directly applied, so that the larger cross section is available for liquid transport, reducing the liquid pressure drop. Using a larger pore size wick in the thicker sidewalls can further enhance the characteristics of such a wick. The evaporative surface and the barrier wall are then made with finer pore sizes, and the finer evaporative pores draw liquid from the coarser wick, while the finer barrier wall wick allows operation against high gravitational or accelerational heads.

Another structure that reduces the liquid pressure drop is a web structure built into the interior of the cup. Such a structure extends longitudinally from the barrier wall toward the open end of the cup and across the interior between two or more sides. Such a web decreases the liquid pressure drop by increasing the wick cross section, delivers liquid to large portions of the heated wick, and permits heat input around the entire enclosure. The web's position in the interior of the cup and away from the heat input improves its liquid transport capability because very little of its volume is occupied by vapor. The web can also be constructed with a tunnel artery to further facilitate liquid distribution.

The ridge wick is a variation of the web structure that also provides increased wick cross section and allows more liquid flow into the wick sidewalls. Such a structure is essentially a partial web in that it extends longitudinally along the sidewall from the barrier wall, but it does not extend completely across the interior to another sidewall. Nevertheless, it furnishes liquid to much of the heated sidewall and is relatively vapor free.

The tunnel artery wick is an enhancement that immensely increases the liquid transport capability of ridge wicks and web structures. In such a configuration the ridges or webs of wick material include longitudinally extending tunnel arteries located inward, toward the center of the enclosure and away from the heated sidewall. The arteries are therefore somewhat isolated from the heat and the generated vapor. Such arteries extend through the barrier wick and directly into the reservoir of the capillary loop. Thus, liquid enters the arteries and moves directly into proximity with most of the length of the evaporator's wick. In effect the tunnel artery wick places parts of the liquid supplying reservoir adjacent to the very part of the evaporator wick that uses the liquid.

However, tunnel arteries have the risk of boiling and blockage of liquid flow by vapor if a heat source is too close to a tunnel. The present invention therefore includes several design enhancements to counteract this problem, the simplest of which is to simply modify the ridge into a higher ridge protruding farther inward toward the center of the evaporator. Locating the arteries in the part of the ridge nearest to the center of the evaporator reduces the heat flow into the artery and reduces the risk of boiling and vapor blockage.

Another approach to preventing boiling in the arteries is the use of isolating wicks of finer pore structure or lower thermal conductivity between the heat source and the artery. Such isolating wicks can be located at the artery as an artery wall structure, at the junction between the artery support ridge and the evaporative wick on the sidewalls of the enclosure, or anywhere between those locations. Such construction encourages vapor flow around rather than through the isolating wick and thus avoids accumulation of vapor in the arteries.

The arteries can also be constructed to include cable arteries. A cable artery is essentially a structure that has a multiple strand cable running through its length. The cable then pumps liquid along its length by capillary action between its strands, and has the advantage of allowing vapor to vent back into the reservoir in the annular space around the cable without blocking the liquid flow within the cable. Other high permeability arteries similar to cable arteries can also be constructed from mesh screen and metal felt. The added benefit of operation in a zero gravity environment can be attained by installing a reservoir wick on the interior walls of the reservoir and extending the high permeability arteries into contact with the reservoir wick. The reservoir wick then collects liquid in the reservoir and moves it into the evaporator through the high permeability arteries. This action can be enhanced even further by installing an additional wick structure in the reservoir, such as a web interconnecting opposite sidewalls, thereby capturing more liquid that is directed into the evaporator arteries.

Another way to feed liquid to the evaporator wick is the use of tubing extending from the reservoir into tunnels within the evaporator wick. The tubing extends well into each of the tunnels, and all the lengths of tubing are connected to a common liquid manifold within the reservoir. The liquid manifold is fed by the liquid return line from the condenser, and any vapor in the tunnel can escape back into the reservoir through the annular gap between the tubing and the tunnel wall. A reservoir wick then captures and returns liquid condensed from the escaped vapor back into the evaporator wick.

Cable and other high permeability arteries and tubing fed tunnels lend themselves to a structure that significantly simplifies the construction of an evaporator for a capillary loop. As previously described, the conventional evaporator has both an evaporator wick on the sidewalls of the enclosure and a barrier wick across the enclosure at one end of the evaporator wick. Not only is the junction of these two wicks a difficult construction problem, but any crack that occurs in the barrier wick will prevent the system from operating. Furthermore, the barrier wick must withstand the difference in pressure between the evaporator and the reservoir.

However, the use of either cable arteries or tubing fed tunnels permits the complete elimination of the barrier wick because liquid is fed to the evaporator wick by the cables or the tubing, and it also permits the separation of the evaporator and reservoir enclosures. When the evaporator and reservoir enclosures are separated, all that is needed is that the two enclosures have interconnecting pipes or tubing sealed to both enclosures through which excess vapor and the tunnel arteries, cable arteries, or artery feed tubes can pass.

The present invention thereby provides a capillary loop evaporator that has improved heat transfer from the heat source to the evaporator wick, reduced likelihood of vapor blockage of the liquid supply, and particularly with the separated evaporator and reservoir, reduced parasitic heat loss to the reservoir.

DETAILED DESCRIPTION OF THE INVENTION

Figure 1:
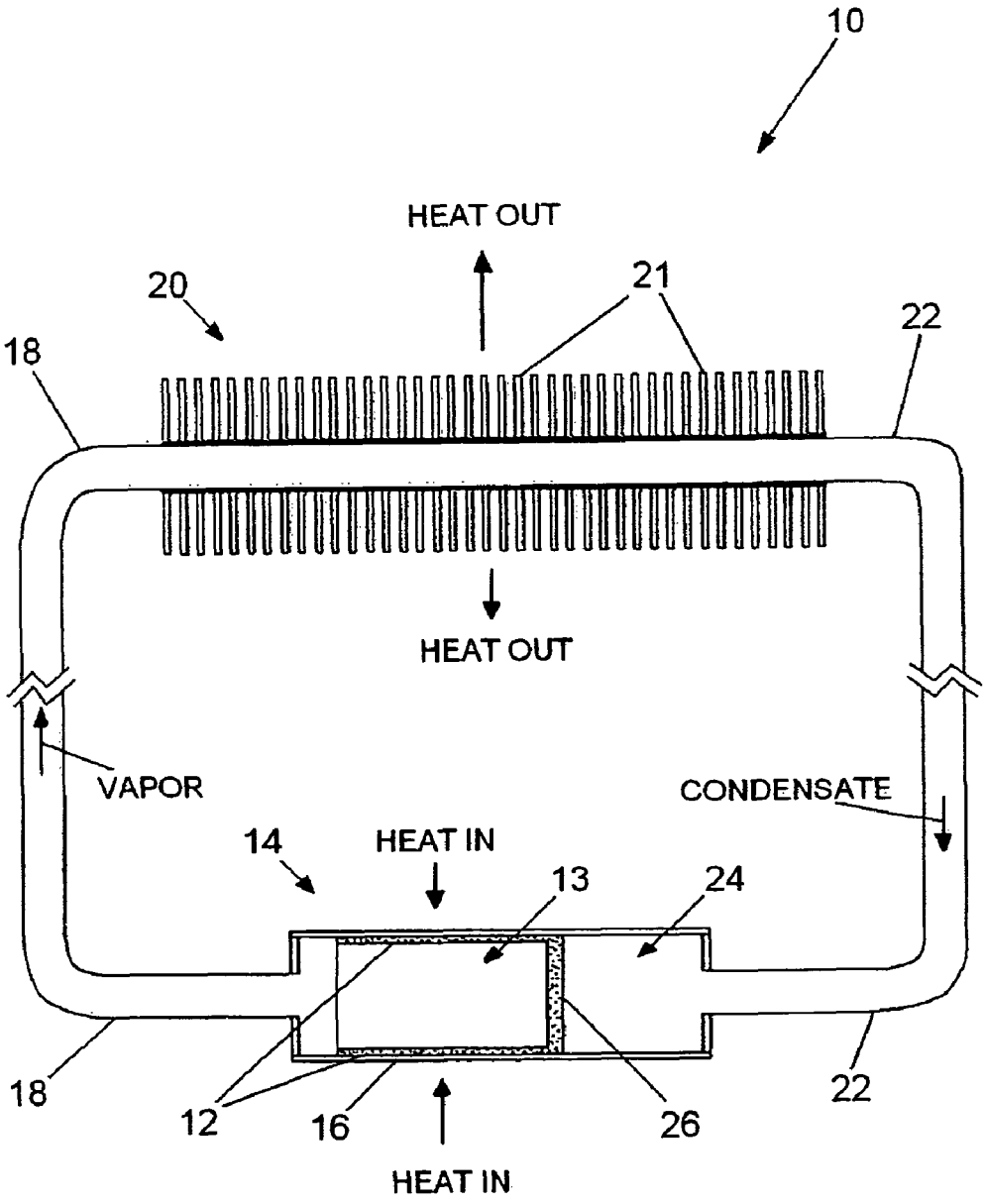
FIG. 1 is a schematic diagram of the typical capillary loop showing the location of the evaporator wick of the preferred embodiment.
Figure 2:
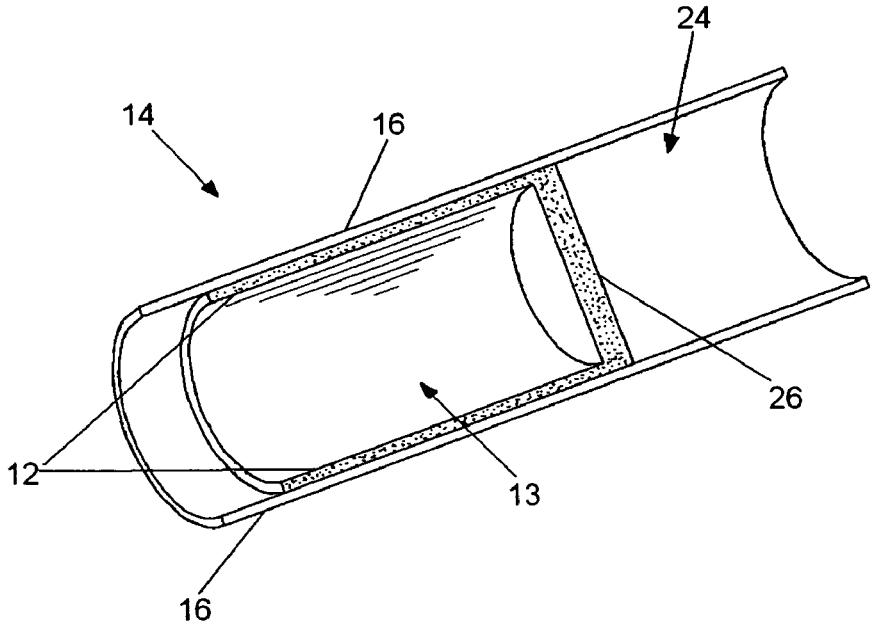
FIG. 2 is a perspective cut away view showing the interior of the basic evaporator of the preferred embodiment of the invention

FIG. 1 is a schematic diagram of typical capillary loop 10 showing evaporator wick 12 of the preferred embodiment of the invention within evaporator 14. Evaporator wick 12 of FIG. 1 is a simple cup and is also shown in FIG. 2 in a perspective cut away view to better show the interior of evaporator 14. The important characteristic of evaporator wick 12 is that all the outer surfaces of its sidewalls are in intimate contact with heated walls 16 of the enclosure forming evaporator 14. This complete contact between evaporator wick 12 and heated enclosure walls 16 makes heat transfer and vaporization of the liquid within evaporator wick 12 much more effective, and the vapor generated moves through evaporator wick 12 into vapor space 13.

When capillary loop 10 is in operation, heat enters evaporator 14 and travels through evaporator enclosure wall 16 into wick 12 which is saturated with liquid. The heat causes the liquid to vaporize, and the vapor pressure moves the vapor out of evaporator wick 12, into vapor space 13, to vapor line 18, and then into condenser 20. Since condenser 20 is cooled by fins 21, the vapor within it condenses, and, driven by the vapor pressure generated in evaporator 14, the condensate liquid moves into liquid line 22 and back to reservoir 24 within evaporator 14. Barrier wick 26, which is attached to evaporator wick 12, separates the liquid in reservoir 24 from vapor space 13 and moves the liquid by capillary action from reservoir 24 into evaporator wick 12, from where the continuous cycle is repeated.

Capillary loop 10 is shown in an orientation that is ideal for gravity aided operation, in which the condensate flows down liquid line 22 under the influence of gravity. However, loop 10 will also operate against gravity if it contains sufficient liquid, including liquid in vapor line 18, to assure that evaporator wick 12 is wetted when heat is not being applied. In such a circumstance, when heat is applied the generated vapor will displace any liquid from vapor line 18 and the necessary part of condenser 20, and when the loop is operating, the displaced liquid will be located in the internal volume of reservoir 24.

FIGS. 3 through 6 are perspective cut away views of alternate embodiments of the invention showing the interior of evaporator 14 with evaporators of different construction. In each embodiment evaporator 14 is the same except for the specific structure of the evaporator wick.

Figure 3:
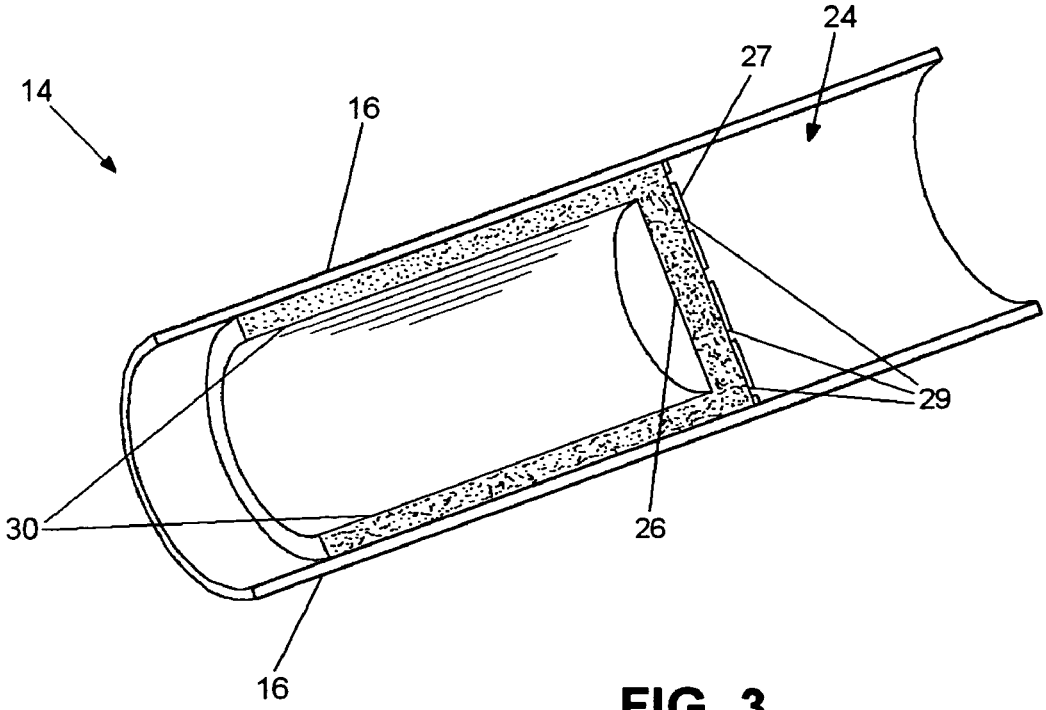
FIG. 3 is a perspective cut away view showing the interior of an alternate embodiment of an evaporator of the invention with an evaporator wick of greater thickness and a strength enhancing barrier plate.

FIG. 3 shows evaporator 14 with the sidewalls of evaporator wick 30 having greater thicknesses than evaporator wick 12 of FIG. 2. This increase in thickness of evaporator wick 30, and in fact any increase in thickness of the sidewalls of an evaporator wick, adds cross section area to the liquid flow path and thereby reduces the liquid pressure drop within the wick. This enhances the ability of the wick to furnish liquid for evaporation to its regions that are most remote from barrier wick 26, which is the initial source of the liquid in the wick. Wick thickness, and the pore size within the wick, can also be used to better accommodate an evaporator to different liquids and different heat loads. FIG. 3 also shows strengthening plate 27 which is a solid plate bonded to or formed within barrier wick 26. Strengthening plate 27 not only prevents cracks in barrier wick 26 but assures that a crack that occurs in barrier wick 26 will not prevent the system from operating, and plate 27 helps barrier wick 26 withstand the difference in pressure between the evaporator and the reservoir. Holes 29 in plate 27 provide access to barrier wick 26 so that liquid in reservoir 24 can enter barrier wick 26.

Figure 4:
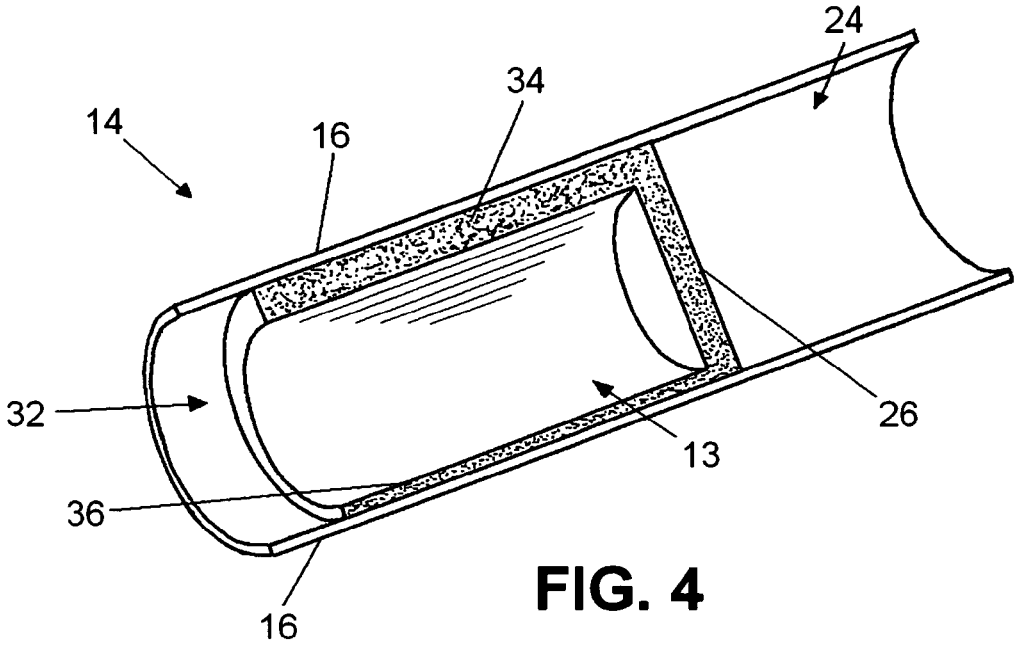
FIG. 4 is a perspective cut away view showing the interior of an alternate embodiment of an evaporator of the invention with an evaporator wick with sidewalls of varying thicknesses.

FIG. 4 is a perspective cut away view showing the interior of an alternate embodiment of an evaporator of the invention with evaporator wick 32 having varying thicknesses. Thus, portion 34 of wick 32 has a greater thickness than portion 36. Such a configuration is advantageous when the heat input into evaporator 14 is restricted to a specific area of the evaporator. In such an application thinner portion 36 is located adjacent to the heat input of evaporator 14 so that vapor formed in portion 36 has a shorter travel path to vapor space 13, and vapor can more easily escape and thereby maintain a lower evaporative temperature drop. Thicker sidewall portion 34, located where there is little or no heat input, furnishes a larger cross section, thus reducing the liquid pressure drop and furnishing more liquid to heated thinner portion 36.

It should be appreciated that the very gradual transition from thinner to thicker wick portions on opposite sides of the evaporator as shown in FIG. 4 is not a requirement for the benefit to be derived, and it is also possible to have a relatively steep transition to a thicker portion of wick that occupies much more of the sidewalls of the evaporator. Furthermore, larger pore sizes within the thicker portion of the wick can also improve the action of the wick.

Figure 5:
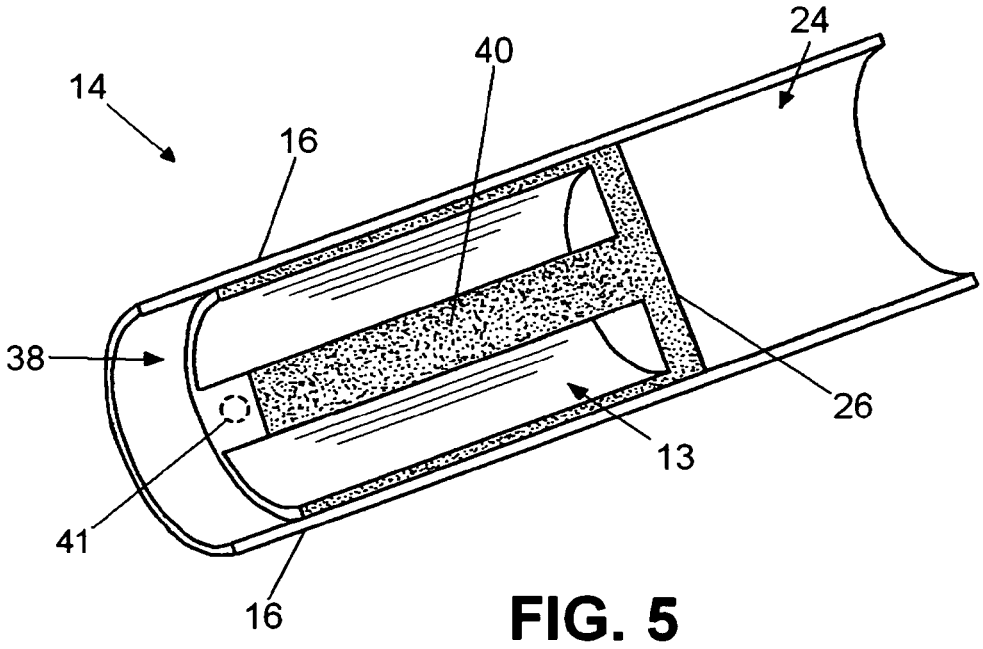
FIG. 5 is a perspective cut away view showing the interior of an alternate embodiment of an evaporator of the invention with an evaporator wick which includes a web wick structure across the interior of the evaporator.
Figure 10:
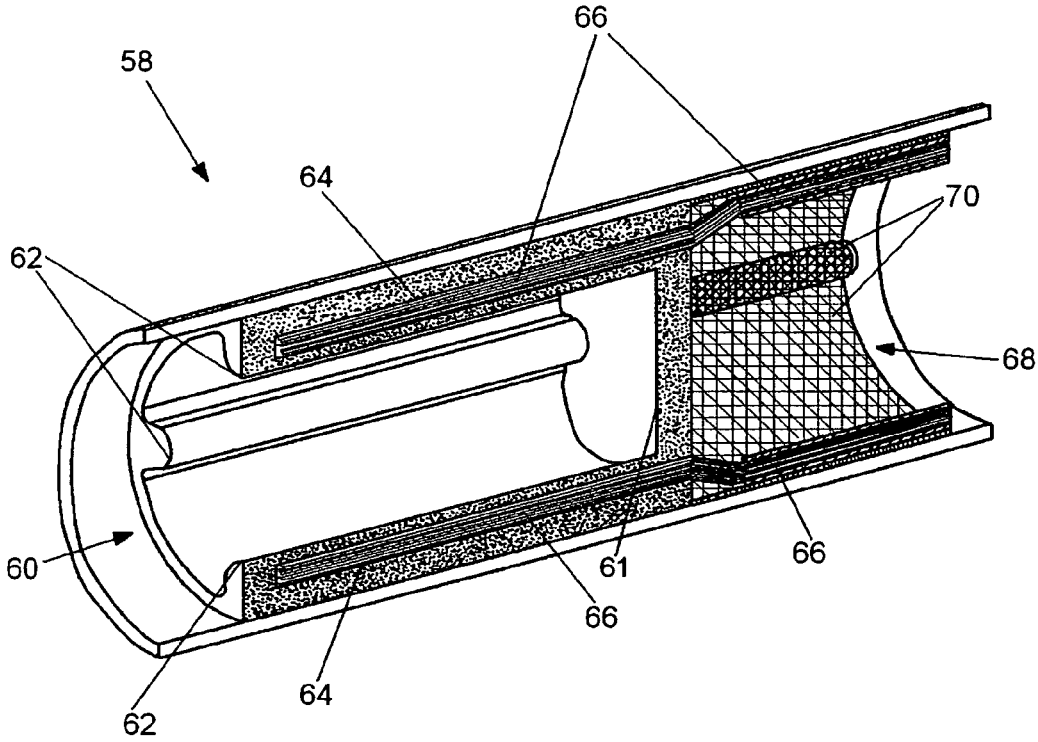
FIG. 10 is a perspective cut away view showing the interior of an alternate embodiment of an evaporator of the invention which has an evaporator wick that includes longitudinal ridges with tunnels and cable arteries within the tunnels.
Figure 11:
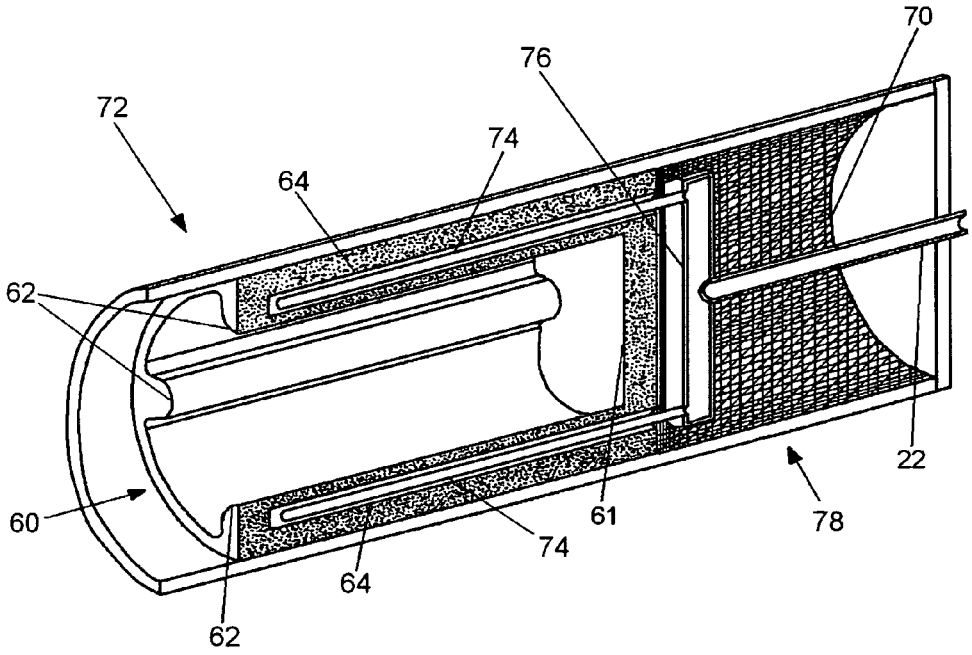
FIG. 11 is a perspective cut away view showing the interior of an alternate embodiment of an evaporator of the invention with an evaporator wick which includes longitudinal ridges with tunnels and tubing that feeds liquid from a manifold in the reservoir into the tunnels.

FIG. 5 is a perspective cut away view showing the interior of another alternate embodiment of an evaporator of the invention with evaporator wick 38 constructed to include wick web structure 40 across the interior of the evaporator. The benefit of web structure 40 is similar to that of a section of thicker wick sidewall in that it provides an increased cross section and multiple paths for feeding liquid to the heated portions of the wick. Web structure 40 extends longitudinally from barrier wick 26 toward the open end of the cup structure of evaporator wick 38 and across the interior between sidewalls of the cup. Although FIG. 5 suggests only a single web structure across the evaporator, a true web with multiple extensions across vapor space 13 is also possible. FIG. 5 also shows tunnel artery 41 located within web 40. Tunnel arteries are discussed in greater detail in the following text, but it is important to appreciate that tunnel artery 41 passes through barrier wick 26 and opens into reservoir 24, but is dosed off at the end of web 40 seen in FIG. 5. It is also important to appreciate that such a tunnel artery can also include within it cable arteries as shown in FIG. 10, other high permeability arteries, and feed tubes as shown in FIG. 11.

Figure 6:
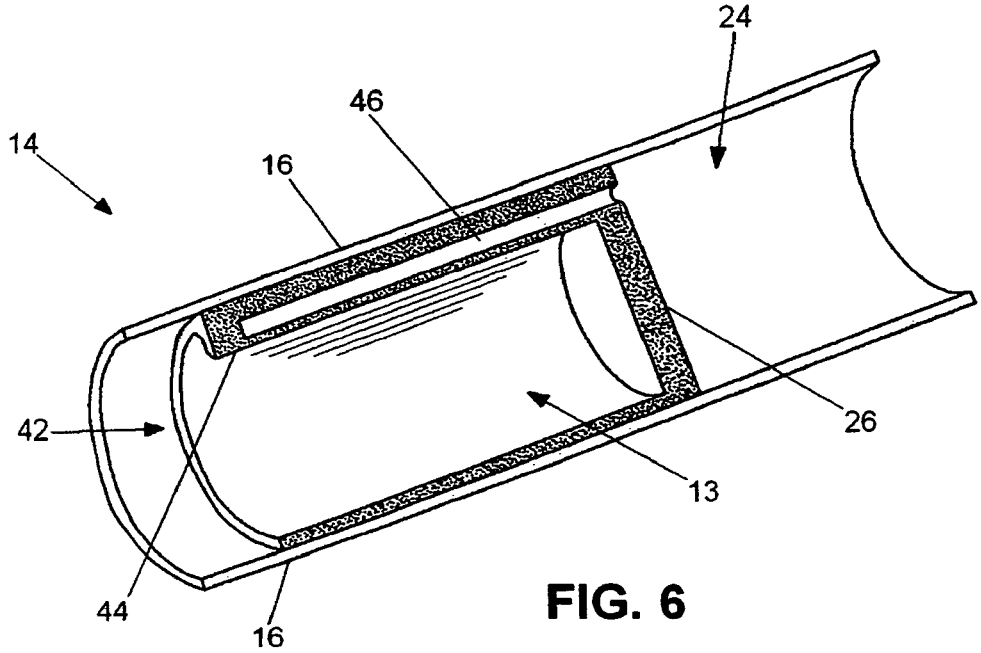
FIG. 6 is a perspective cut away view showing the interior of an alternate embodiment of an evaporator of the invention with an evaporator wick which includes a longitudinal ridge with a tunnel artery.

FIG. 6 is a perspective cut away view showing the interior of another alternate embodiment of an evaporator of the invention in which evaporator wick 42 includes limited width longitudinal ridge 44 within which is tunnel artery 46. Ridge 44 itself, even without a tunnel artery, provides the benefit of increased wick cross section to facilitate liquid transport to the sidewalls of the wick. The fact that ridge 44 protrudes radially inward toward the center of vapor space 13 makes it less likely to contain vapor that would block liquid flow. Tunnel artery 46 further enhances the ability of ridge 44 to transport liquid to heated portions of wick 42, and this technique operates for an evaporator in which the entire evaporator is heated when multiple ridges 44 including arteries 46 are included around the evaporator. Tunnel artery 46 is located in the part of ridge 44 that is most remote from heated wall 16 to minimize vapor interference with the liquid flow, and tunnel artery 46 extends longitudinally over a large portion of evaporator wick 42 and opens directly into reservoir 24. The effect of this structure is essentially to extend reservoir 24 and its liquid supply into close contact with the heated portions of evaporator wick 42.

Figure 7:
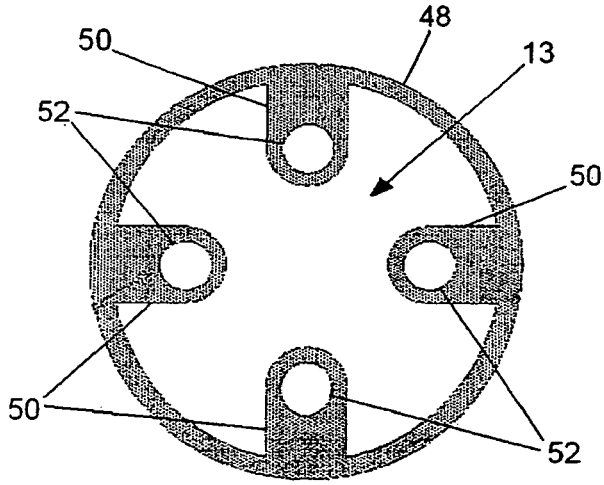
FIG. 7 is a cross section view across a cylindrical evaporator wick showing an alternate embodiment of the invention in which the evaporator wick includes high longitudinal ridges with tunnel arteries.
Figure 8:
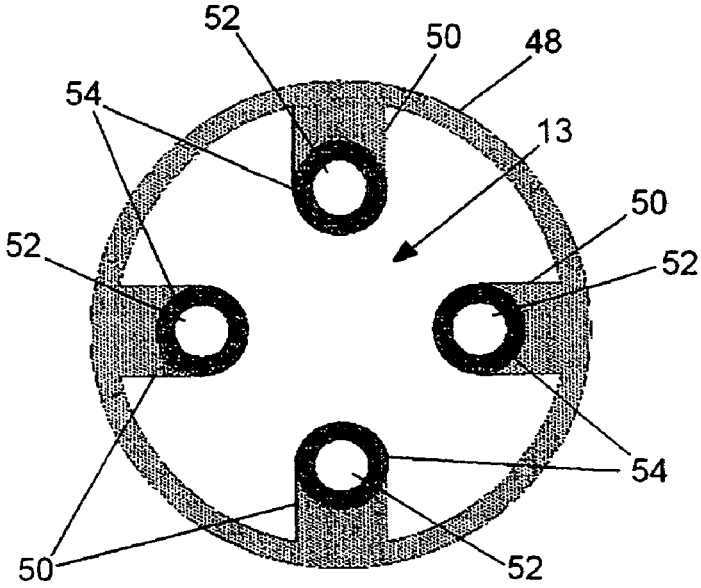
FIG. 8 is a cross section view across a cylindrical evaporator wick showing an alternate embodiment of the invention in which the evaporator wick includes high longitudinal ridges with tunnel arteries including artery walls with isolating wicks with pore structures that prevents vapor flow into the arteries.
Figure 9:
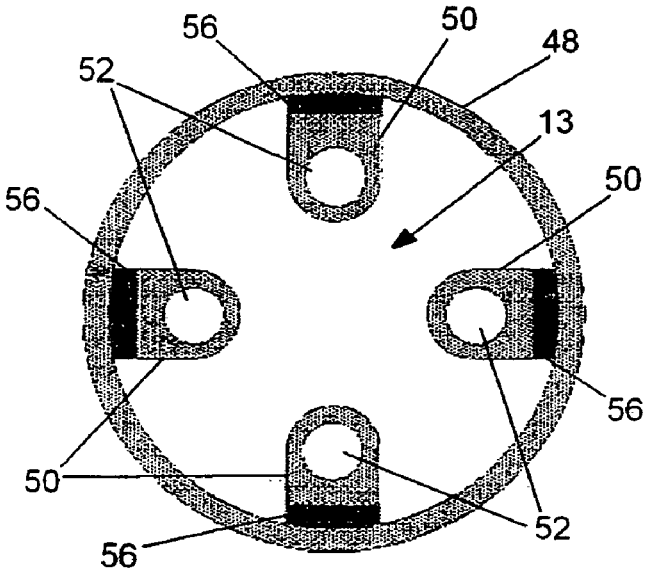
FIG. 9 is a cross section view across a cylindrical evaporator wick showing an alternate embodiment of the invention in which the evaporator wick includes high longitudinal ridges with tunnel arteries and isolating wick structures within the ridges that have pore structures that prevent vapor flow into the arteries.

FIGS. 7-9 are cross section views across a cylindrical evaporator wick 48 showing alternate embodiments of the invention in which the evaporator wick 48 includes high longitudinal ridges 50 with tunnel arteries 52 protruding into vapor space 13. These alternate embodiments reduce the risk of boiling within the arteries that is sometimes caused when a heat source is too close to the artery. Such boiling causes vapor blockage of the liquid flow in the artery.

FIG. 7 shows the basic structure of high ridges 50 within evaporator wick 48. Arteries 52 are located in the parts of the ridges that are as remote as possible from the heat source located at the outer circumference of evaporator wick 48, as shown in FIG. 1.

FIG. 8 shows an enhanced structure for high ridges 50 of evaporator wick 48. Tunnel arteries 52 of FIG. 8 are shown with walls that are constructed with isolating wicks 54. Isolating wicks 54 have finer pore structures than the rest of the ridges. Isolating wicks 54 prevent vapor flow into the arteries because the vapor travels the path of least resistance and moves out of the ridges and into vapor space 13 rather than moving through the more restrictive fine pore structure of isolating wicks 54.

FIG. 9 shows another location for isolating wick structures 56 within high ridges 50 of evaporator wick 48. Isolating wick structures 56 are located within high ridges 50 and have the same fine pore structure as isolating wicks 54 of FIG. 8 that prevents vapor flow into the arteries. The essential difference of isolating wicks 56 is that they are located within ridges 50 rather than around the arteries as are isolating wicks 54 of FIG. 8. Nevertheless, the action of isolating wicks 56 is the same as those of isolating wicks 54 because isolating wicks 56 span across the entire cross sections of high ridges 50 and therefore divert vapor into vapor space 13 to prevent the vapor from entering arteries 52. It should be appreciated that isolating wicks can be located anywhere along the height of high ridges 50.

FIG. 10 is a perspective cut away view showing the interior of an alternate embodiment of the invention that is an evaporator 58 with evaporator wick 60 and barrier wick 61. Evaporator wick 60 includes longitudinal ridges 62 with tunnels 64 and cable arteries 66 within tunnels 64. However, other high permeability arteries similar to cable arteries, such as those constructed from mesh screen and metal felt can also be used within tunnels 64. Cable arteries 66 are essentially multiple strand cables running through the length of tunnels 64. Cables 66 then pump liquid along their lengths by capillary action between the strands, and have the advantage of allowing vapor to vent back into reservoir 68 by means of the open volumes around cables 66 without blocking the liquid flow within the cables. The added benefit of operation in a zero gravity environment can be attained by installing reservoir wick 70 on the interior walls of reservoir 68 and extending cable arteries 66 into contact with reservoir wick 70. Reservoir wick 70 then collects liquid in reservoir 68 and moves it into evaporator 60 through cable arteries 66. This action can be enhanced even further by installing an additional wick structure in the reservoir, such as a web across reservoir 68 interconnecting opposite sidewalls, thereby capturing more liquid that can be directed into cable arteries 66.

FIG. 11 is a perspective cut away view showing the interior of another alternate embodiment of the invention with evaporator 72 that has evaporator wick 60 and barrier wick 61. Evaporator wick 60 includes longitudinal ridges 62 with tunnels 64. To this extent the evaporator wick structure is the same as shown in FIG. 10. However, instead of cable arteries within tunnels 64, evaporator 72 has tubing 74 that feeds liquid into tunnels 64. Tubing 74 extends well into each of the tunnels, and all the multiple lengths of tubing are connected to common liquid manifold 76 within reservoir 78. Manifold 76 receives liquid directly from liquid return line 22 (see FIG. 1), and any vapor in tunnels 64 can escape back into reservoir 78 through the annular gap between tubing 74 and the walls of tunnels 64. As in FIG. 10, reservoir wick 70 then captures and returns liquid condensed from the escaped vapor back to the evaporator wick 60. An additional wick can also be added to partially occupy the annular space between tubing 74 and tunnel walls and be in contact with reservoir wick 70 to return the reservoir condensed liquid to evaporator wick 60.

Figure 12:
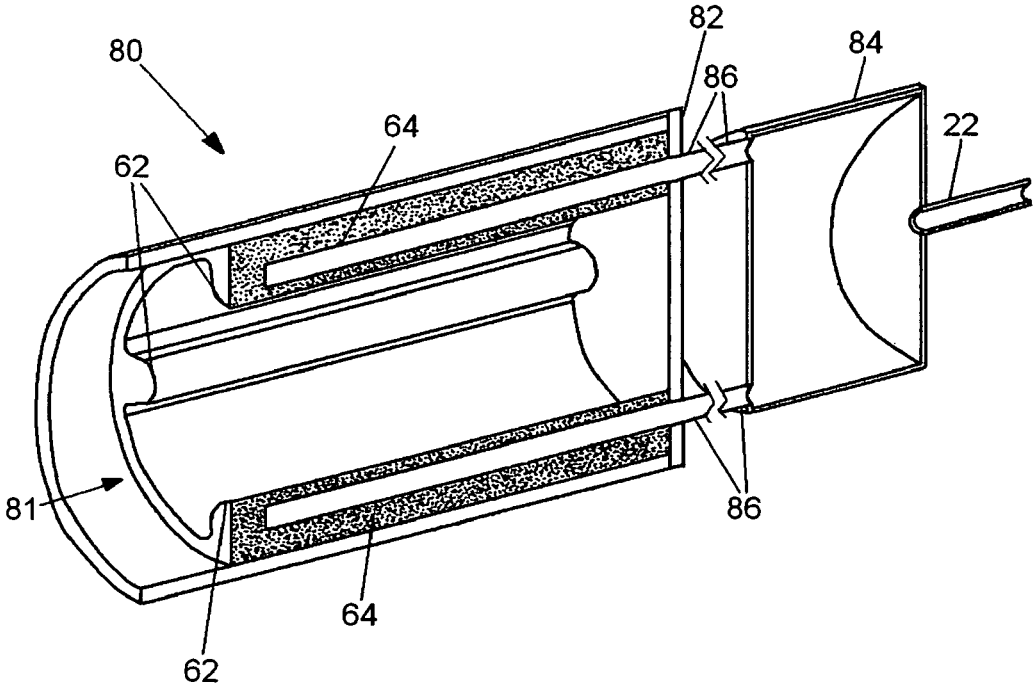
FIG. 12 is a perspective cut away view showing the interior of an alternate embodiment of the evaporator of the invention with a detached and separated reservoir rather than an integrated reservoir.

FIG. 12 is a perspective cut away view showing the interior of evaporator 80 that is very similar to evaporator 72 of FIG. 11 except that it does not have a barrier wick or an integrated reservoir as in evaporator 72 of FIG. 11. Instead of an integrated reservoir and a barrier wick at the end of evaporator wick 81, evaporator 80 has sealed end plate 82, and evaporator 80 is connected to detached and separated reservoir 84 by lengths of connecting tubing 86.

The use of connecting tubing 86 to feed tunnels 64 permits the complete elimination of barrier wick 26 (FIGS. 1-6) because liquid is fed to the evaporator wick through connecting tubing 86. This structure permits the physical separation of the enclosures of evaporator 80 and reservoir 84. When the evaporator and reservoir enclosures are separated, all that is needed is that the two enclosures have connecting tubing 86 sealed to both enclosures so that tunnels 64 are fed directly from connecting tubing 86, and connecting tubing 86 acts as extensions of tunnels 64. A further advantage of the structure shown in FIG. 12 is that connecting tubing 86 can also enclose high permeability arteries, cable arteries 66 as shown in FIG. 10, or feed tubing 74 as shown in FIG. 11, and with such a structure it is quite simple to make the connection between evaporator 80 and reservoir 84 flexible. As indicated by the break lines shown in FIG. 12, connecting tubing 86 can span different distances which will essentially be determined by the liquid flow and vapor pressure characteristics of entire capillary loop 10 of FIG. 1 and the capillary capability of the artery.

Figure 13:
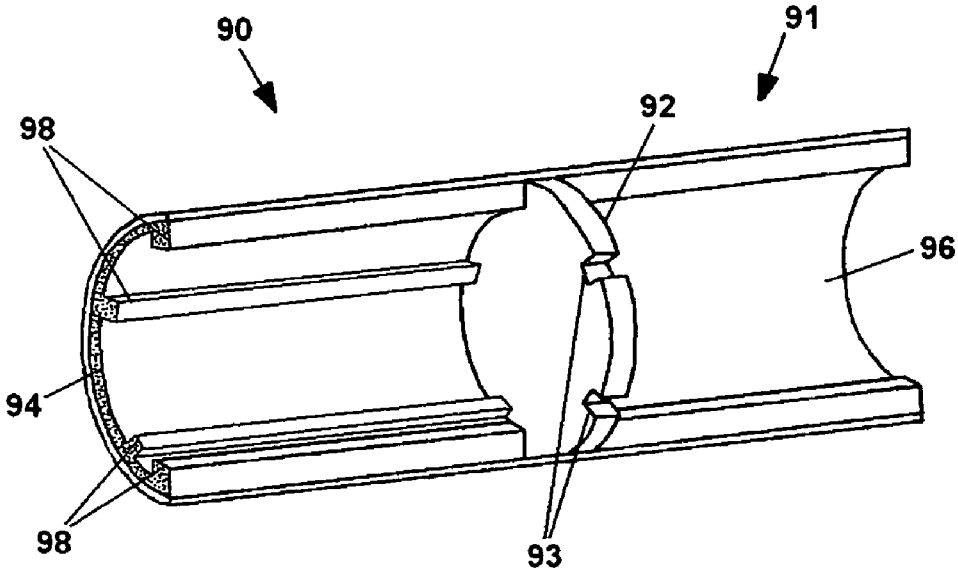
FIG. 13 is a perspective cut away view showing the interior of an alternate embodiment of the evaporator of the invention with a barrier formed within an easily sintered combined evaporator wick and reservoir wick.

FIG. 13 is a perspective cut away view showing the interior of an alternate embodiment of the invention with evaporator 90 and reservoir 91. This embodiment includes barrier 92 formed between easily sintered continuous evaporator wick 94 and reservoir wick 96. Evaporator wick 94 and reservoir wick 96 are formed as a continuous structure that includes ridges 98, which also run continuously between evaporator wick 94 and reservoir wick 96. Barrier 92, including through passages 93 for wick material, is formed to mate with continuous evaporator wick 94, reservoir wick 96, and ridges 98, so that the only paths available between evaporator wick 94 and reservoir wick 96 for liquid and vapor are within the wick material itself. Such a structure can be formed by sintering in one operation, but barrier 92 can be either capillary material or a previously constructed solid structure sintered in place. The sintering process permits many variations in the structures of barrier 92 and ridges 98 so that the shape of through passages 93 can include, among others, the rectangular slots shown or circular holes. Ridges 98 can also have various shapes and can include tunnel arteries as shown in FIG. 6, cable arteries as shown in FIG. 10, or feed tubes as shown in FIG. 11. In some cases ridges 98 may not be needed with evaporator wick 96 and reservoir wick 96 having smooth inner surfaces. Furthermore, the shape of barrier 92 can be constructed to mate with any enclosure configuration.

The present invention thereby provides a capillary loop evaporator that has improved heat transfer from the heat source to the evaporator wick, reduced likelihood of vapor blockage of the liquid supply, and particularly with the separated evaporator and reservoir, reduced parasitic heat loss to the reservoir.

It is to be understood that the forms of this invention as shown are merely preferred embodiments. Various changes may be made in the function and arrangement of parts;

equivalent means may be substituted for those illustrated and described; and certain features may be used independently from others without departing from the spirit and scope of the invention as defined in the following claims. For example, the evaporator and the evaporator wick structures need not be circular cylinders, but could be constructed with planar surfaces and also with a smaller space between two opposite sides to yield a slab-like structure.

What is claimed as new and for which Letters Patent of the United States are desired to be secured is:

1. An evaporator for a capillary loop comprising:

an enclosure with heat transmitting walls, a vapor exit opening interconnected with a vapor line, and a liquid entry opening interconnected with a liquid supply line;

an evaporator wick located within the enclosure, constructed of porous material and including wick sidewalls with inner surfaces and smooth continuous outer surfaces, with the inner surfaces of the wick sidewalls forming boundaries of a central interior vapor space that is directly accessible to the vapor exit opening and with the entire structure of the continuous outer surfaces of the wick sidewalls in full intimate contact with the enclosure's heat transmitting walls; and a barrier wick constructed of porous material, spanning across the enclosure, attached to the evaporator wick sidewalls, closing off and isolating the central vapor space from the liquid entry opening, and, along with reservoir walls, defining a liquid reservoir volume to hold liquid between the barrier wick and the liquid entry opening.

2. The evaporator of claim 1 further including a solid strengthening plate bonded to the barrier wick and holes in the strengthening plate providing liquid access to the barrier wick from the reservoir.

3. The evaporator of claim 1 wherein at least some part of the evaporator wick sidewalls has a thickness between the vapor space and the heat transmitting walls that is greater than the thickness on another part of the evaporator wick sidewalls.

4. The evaporator of claim 1 further including a web structure constructed of porous material oriented across the vapor space from one part of the sidewalls to another part of the sidewalls.

5. The evaporator of claim 1 further including a web structure constructed of porous material oriented across the vapor space from one part of the sidewalls to another part of the sidewalls and with a tunnel artery that extends longitudinally within the web structure, through the barrier wick, and opens to the reservoir volume.

6. The evaporator of claim 1 further including a ridge structure constructed of porous material, protruding from an inner surface of the evaporator wick sidewall into the volume of the vapor space and extending longitudinally along a sidewall, and contacting the barrier wick.

7. The evaporator of claim 1 further including a ridge structure constructed of porous material, protruding from an inner surface of the evaporator wick sidewall into the volume of the vapor space, extending longitudinally along the sidewall, and contacting the barrier wick; and a tunnel artery that extends longitudinally within the ridge structure, through the barrier wick, and opens into the reservoir volume.

8. The evaporator of claim 1 further including a ridge structure constructed of porous material, protruding from an inner surface of the evaporator wick sidewall into the volume of the vapor space, extending longitudinally along the sidewall, and contacting the barrier wick; a tunnel artery that extends longitudinally within the ridge structure, through the barrier wick, and opens into the reservoir volume; and a high permeability artery extending longitudinally within the tunnel artery, through the barrier wick, and into the reservoir volume.

9. The evaporator of claim 1 further including a ridge structure constructed of porous material, protruding from an inner surface of the evaporator wick sidewall into the volume of the vapor space, extending longitudinally along the sidewall, and contacting the barrier wick; a tunnel artery that extends longitudinally within the ridge structure, through the barrier wick, and opens into the reservoir volume; a high permeability artery extending longitudinally within the tunnel artery, through the barrier wick, and into the reservoir volume; and a capillary action reservoir wick within the reservoir and in contact with the high permeability artery.

10. The evaporator of claim 1 further including a ridge structure constructed of porous material, protruding from an inner surface of the evaporator wick sidewall into the volume of the vapor space, extending longitudinally along the sidewall, and contacting the barrier wick; and a tunnel artery that extends longitudinally within the ridge structure, through the barrier wick, and opens to the reservoir volume, wherein the walls of the tunnel artery are constructed of porous material with a finer pore structure than the porous material of the rest of the ridge structure to form an isolating wick structure around the tunnel artery.

11. The evaporator of claim 1 further including a ridge structure constructed of porous material, protruding from an inner surface of the evaporator wick sidewall into the volume of the vapor space, extending longitudinally along the sidewall, and contacting the barrier wick; and a tunnel artery that extends longitudinally within the ridge structure, through the barrier wick, and opens to the reservoir volume; wherein the ridge includes an isolating wick structure spanning across the entire cross section of the ridge and constructed of porous material with a finer pore structure than the porous material of the rest of the ridge structure.

12. The evaporator of claim 1 further including a ridge structure constructed of porous material, protruding from an inner surface of an evaporator wick sidewall into the volume of the vapor space, extending longitudinally along the sidewall, and contacting the barrier wick; a tunnel artery that extends longitudinally within the ridge structure, through the barrier wick, and opens to the reservoir volume; and tubing extending longitudinally within the tunnel artery, through the barrier wick, and into a liquid manifold within the reservoir volume; with the liquid manifold interconnected with the liquid supply line.

13. The evaporator of claim 12 further including a capillary action reservoir wick within the reservoir enclosure and in contact with the barrier wick.

* * * * *